US010750858B1

(12) United States Patent
Barre et al.

(10) Patent No.: US 10,750,858 B1
(45) Date of Patent: Aug. 25, 2020

(54) RECONFIGURABLE MODULAR STORAGE SYSTEM

(71) Applicant: NEATFREAK GROUP INC., Mississauga (CA)

(72) Inventors: Bertrand Barre, Lapeyrouse (FR); Francis Lepage, Dommartin (FR); Yan Feng, Mississauga (CA); Dana Musat, Toronto (CA)

(73) Assignee: NEATFREAK GROUP INC., Mississauga, Ontario (CA)

( * ) Notice: Subject to any disclaimer, the term of this patent is extended or adjusted under 35 U.S.C. 154(b) by 0 days.

(21) Appl. No.: 16/426,185

(22) Filed: May 30, 2019

(51) Int. Cl.
*A47B 47/00* (2006.01)
*A47B 83/00* (2006.01)
(Continued)

(52) U.S. Cl.
CPC ..... *A47B 47/0091* (2013.01); *A47B 45/00* (2013.01); *A47B 47/0041* (2013.01);
(Continued)

(58) Field of Classification Search
CPC .. A47F 5/10; A47F 5/13; A47F 5/0031; A47F 5/00; A47F 5/0018; A47F 5/01; A47F 5/14; A47B 61/00; A47B 47/022; A47B 47/027; A47B 47/04; A47B 47/028; A47B 96/021; A47B 47/0091; A47B 47/0025; A47B 47/0041; A47B 47/005; A47B 47/0058; A47B 47/0083; A47B 47/02; A47B 91/02; A47B 47/021; A47B 87/00; A47B 87/001; A47B 87/005; A47B 83/00;
(Continued)

(56) References Cited

U.S. PATENT DOCUMENTS 3,217,671 A * 11/1965 Walsh ..... A47B 87/02 108/91
3,567,300 A * 3/1971 Mari ..... A47B 87/005 312/257.1

(Continued)

OTHER PUBLICATIONS

Amazon, Inc.; Whitmor Deluxe Double Rod Adjustable Closet Organization System; URL: https://www.amazon.com/dp/B00DBRL4N6/; at least as early as May 16, 2014; Amazon Inc., Seattle, Washington.

(Continued)

*Primary Examiner* — Jennifer E. Novosad
(74) *Attorney, Agent, or Firm* — Patzik, Frank & Samotny Ltd.

(57) ABSTRACT

A reconfigurable modular storage system has a reconfigurable support for storage units of the storage system. The reconfigurable support includes an end frame member attachable to the storage unit in two reverse orientations and releasably attachable base members. When the end frame member is attached to the storage unit in a first orientation and the base members are unattached, a portion of the end frame member serves as a raised end railing of the storage unit. When the end frame member is attached to the storage unit in a second orientation and the base members are attached, the base members serve as a load-bearing supports for the end frame member and for the storage unit. Multiple end frame members may be vertically stacked to create multiple vertically stacked storage units.

11 Claims, 4 Drawing Sheets

(51) Int. Cl.

| | |
|---|---|
| ***A47B 87/02*** | (2006.01) |
| ***A47B 91/02*** | (2006.01) |
| ***A47F 5/00*** | (2006.01) |
| ***A47B 87/00*** | (2006.01) |
| ***A47B 47/02*** | (2006.01) |
| ***A47F 5/10*** | (2006.01) |
| ***A47B 45/00*** | (2006.01) |

(52) U.S. Cl.
CPC ..... *A47B 47/0058* (2013.01); *A47B 47/0083* (2013.01); *A47B 47/021* (2013.01); *A47B 47/027* (2013.01); *A47B 83/00* (2013.01); *A47B 87/001* (2013.01); *A47B 87/005* (2013.01); *A47B 87/008* (2013.01); *A47B 87/02* (2013.01); *A47B 87/0207* (2013.01); *A47B 87/0253* (2013.01); *A47B 91/02* (2013.01); *A47F 5/0031* (2013.01); *A47F 5/10* (2013.01)

(58) Field of Classification Search
CPC ..... A47B 87/007; A47B 87/008; A47B 87/02; A47B 87/0207; A47B 87/0253; A47B 87/0276; A47B 87/0284; A47B 55/02; A47B 57/00; A47B 73/002; A47B 61/002; A47B 45/00; A47B 47/00; A47B 46/00
USPC ..... 211/191, 194, 188, 187, 186, 134, 189, 211/204, 206, 175, 2; 312/107, 108, 111, 312/238; 108/27, 106–110, 180, 186, 108/187, 147.11
See application file for complete search history.

(56) References Cited

U.S. PATENT DOCUMENTS 3,655,065 A * 4/1972 Yellin ..... A47B 47/042 211/194
3,730,601 A * 5/1973 Misenheimer, III ..... A47B 87/0215 312/108
4,117,783 A * 10/1978 Eckel ..... A47B 87/0215 108/190
4,199,070 A * 4/1980 Magnussen, Jr. ..... A47B 63/02 138/112
4,247,011 A * 1/1981 Walter ..... A47B 87/0276 211/194
4,321,873 A * 3/1982 Nealis ..... A47B 87/005 108/101
4,391,378 A * 7/1983 Secon ..... A47F 5/13 108/109
4,407,958 A * 10/1983 DeGraff, Jr. ..... B01L 9/06 211/194
4,620,636 A * 11/1986 Herr ..... B42F 7/12 211/11
4,774,792 A * 10/1988 Ballance ..... E04B 2/7431 160/135
4,819,814 A * 4/1989 Fogelgren ..... A47B 47/04 211/133.1
5,016,765 A * 5/1991 Leonardo ..... A47B 47/021 211/182
5,222,610 A * 6/1993 Johansen ..... A47F 7/0028 211/170
5,722,544 A * 3/1998 Williams ..... A47B 87/008 108/107
5,730,300 A * 3/1998 Chen ..... A47B 81/068 206/387.15
5,791,265 A * 8/1998 Ellsworth ..... A47B 47/00 108/180
6,102,219 A * 8/2000 Wang ..... A47B 87/00 211/194
6,142,324 A * 11/2000 Huang ..... A47B 47/0008 211/188
6,209,735 B1 * 4/2001 Gladstone ..... A47F 5/10 211/194
6,216,894 B1 * 4/2001 Hendricks ..... A47B 63/00 211/194
6,230,632 B1 * 5/2001 Moore ..... A47B 47/00 108/180
6,321,918 B1 * 11/2001 Rollins ..... A47B 87/0207 211/194
6,520,095 B1 * 2/2003 Hayes ..... A47B 47/047 108/190
6,595,378 B2 * 7/2003 Wang ..... A47B 47/0075 211/186
6,644,484 B1 * 11/2003 Sardis ..... A47B 43/00 211/189
6,749,070 B2 * 6/2004 Corbett, Jr. ..... A47B 96/1441 211/126.12
6,971,529 B1 * 12/2005 Shapiro ..... A47B 47/00 211/188
6,991,115 B2 * 1/2006 Chow ..... G11B 33/0483 211/188
7,516,853 B1 * 4/2009 Murillo, Jr. ..... A47F 5/0018 211/188
7,918,515 B2 * 4/2011 Wang ..... A47B 87/005 211/194
8,960,458 B1 * 2/2015 Klein ..... A47B 87/0261 211/126.11
2002/0130098 A1 * 9/2002 Simard ..... A47F 5/01 211/181.1
2003/0010738 A1 * 1/2003 Hsia ..... A47B 47/042 211/188
2006/0157435 A1 * 7/2006 Oberhaus ..... A47B 57/12 211/187
2006/0169659 A1 8/2006 Robinson et al.
2006/0207957 A1 * 9/2006 Chen ..... A47B 47/0025 211/188
2008/0000863 A1 1/2008 DiBello
2008/0217275 A1 * 9/2008 Chen ..... A47B 73/006 211/194
2008/0302748 A1 * 12/2008 Tsai ..... A47B 45/00 211/188
2010/0176697 A1 7/2010 Fuerstenau
2010/0252516 A1 * 10/2010 Huang ..... A47B 96/021 211/134
2014/0251934 A1 * 9/2014 Nelson ..... A47B 47/047 211/188
2014/0353270 A1 * 12/2014 Murphy ..... A47B 87/0207 211/188
2016/0081472 A1 * 3/2016 Aleisa ..... A47B 47/0091 211/188
2016/0095430 A1 * 4/2016 Moyer ..... A47B 47/0091 312/265.4

OTHER PUBLICATIONS

Whitmor, Inc.; 6779-3044 Double Rod Standing Closet; Oct. 24, 2011, Whitmor, Inc., Southaven Mississippi.
Barre, Bertrand et al., U.S. Appl. No. 29/696,348 entitled "End Frame of Storage Unit" filed Jun. 27, 2019, having a common applicant, assignee and inventors with the present application.
Barre, Bertrand et al., U.S. Appl. No. 29/696,350 entitled "Frame Support of Storage Unit" filed Jun. 27, 2019, having a common applicant, assignee and inventors with the present application.

* cited by examiner

RECONFIGURABLE MODULAR STORAGE SYSTEM

BACKGROUND OF THE INVENTION

1. Field of the Invention

The present invention relates, in general, to storage units and, more particularly, to cubbyhole, drawer, and shelving units for storing garments and other items, and to modular and reconfigurable storage systems consisting of multiple storage units coupled together.

2. General Background of the Invention

Garment storage units, such as cubbyhole, drawer, and shelving storage units, have been in use for some time. It is sometimes desirable to combine multiple storage units into larger storage systems, such as, for example, to create larger closet organizers.

One shortcoming of certain prior art storage units is that they are incapable of being combined with other storage units to optionally form larger storage systems. Another shortcoming of certain prior art storage units is that, while they may be capable of combination with other storage units into larger systems, it is only multiple, identically configured storage units that are so combinable. Yet another shortcoming of certain prior art storage units is that they have reduced stability when combined together into larger storage systems, particularly when vertically stacking multiple instances of storage units into taller vertical towers.

Accordingly, it is an object of the present invention to provide a modular and reconfigurable storage system enabling multiple storage units to be combined into larger storage systems.

It is another object of the present invention to use common components to construct differing storage units having differing functions and capabilities.

It is a further object of the present invention to use common components, in differing orientations, to construct storage units in differing configurations, depending upon whether a particular storage unit is to be positioned in the lower or upper tier of a tower of multiple storage units.

It is yet another object of the present invention to provide enhanced stability when multiple instances of storage units are vertically stacked.

These and other objects and features of the present invention will become apparent in view of the following specification, drawings and claims.

BRIEF SUMMARY OF THE INVENTION

In a modular storage system, a reconfigurable support for a storage unit comprises an end frame member having a first end and a second end. The end frame member is attachable to the storage unit in a first orientation, wherein the first end is positioned vertically above the second end, and is also attachable to the storage unit in a second orientation, wherein the second end is positioned vertically above the first end. At least one base member is attachable to the first end of the end frame member. When the end frame member is attached to the storage unit in the first orientation and the at least one base member is unattached to the end frame member, at least a portion of the first end of the end frame member serves as a raised end railing of a top surface of the storage unit. Moreover, when the end frame member is attached to the storage unit in the second orientation and the at least one base member is attached to the first end of the end frame member, at least a portion of the at least one base member serves as a load-bearing support for the end frame member and for the storage unit. The storage unit may be selected from the group comprising a shelf storage unit, a drawer storage unit, and a cubbyhole storage unit.

In a preferred embodiment, the at least one base member comprises two base members attachable to the first end of the end frame member in an opposing orientation, relative to each other. The first end of the frame member includes at least one rounded corner region. The at least one base member supports and substantially covers an outer surface of the at least one rounded corner region upon attachment of the at least one base member to the end frame member. Moreover, the at least one base member further comprises a height adjustment member.

At least one footing is attachable to the second end of the frame member, such that, when the end frame member is attached to the storage unit in the first orientation and the at least one footing is attached to the second end of the end frame member, at least a portion of the at least one footing serves as a load-bearing support for the end frame member and for the storage unit. Moreover, the at least one footing further comprises a height adjustment member.

In certain storage unit configurations of the modular storage system having vertically stacked storage units, two instances of the end frame member are stackable by placing a first end frame member in the second orientation, placing a second end frame member above the first end frame member and in the first orientation, and coupling the second end of the first end frame member to the second end of the second end frame member. In this stacking configuration, at least one coupler is employed to couple at least a portion of the second end of the first end frame member to at least a portion of the second end of the second end frame member.

Moreover, in certain storage unit configurations of the modular storage system, a storage unit has a frame comprising two end frame members disposed on opposing sides of the storage unit. The two end frame members may both be in the first orientation. Alternatively, in certain configurations, the two end frame members are both in the second orientation.

In one example of a rather fully configured storage system, eight instances of the end frame member are employed within a storage system having two towers, with each of the two towers consisting of two vertically stacked storage units. In such a system, four of the eight instances of the end frame member are in the first orientation, and four of the eight instances of the end frame member are in the second orientation. Moreover, such a system may further include two hanging rods, each being coupled at their opposing ends to a different end frame member.

In another example of a storage system having multiple storage units, four instances of the end frame member are employed within a storage system having two storage units positioned in a side by side orientation. Each of the four instances of the end frame member may in the first orientation. Moreover, each of the four instances of the end frame member may be in the second orientation. Furthermore, a hanging rod may be coupled between one end frame member of each of the two storage units.

DETAILED DESCRIPTION OF THE INVENTION

Figure 1:
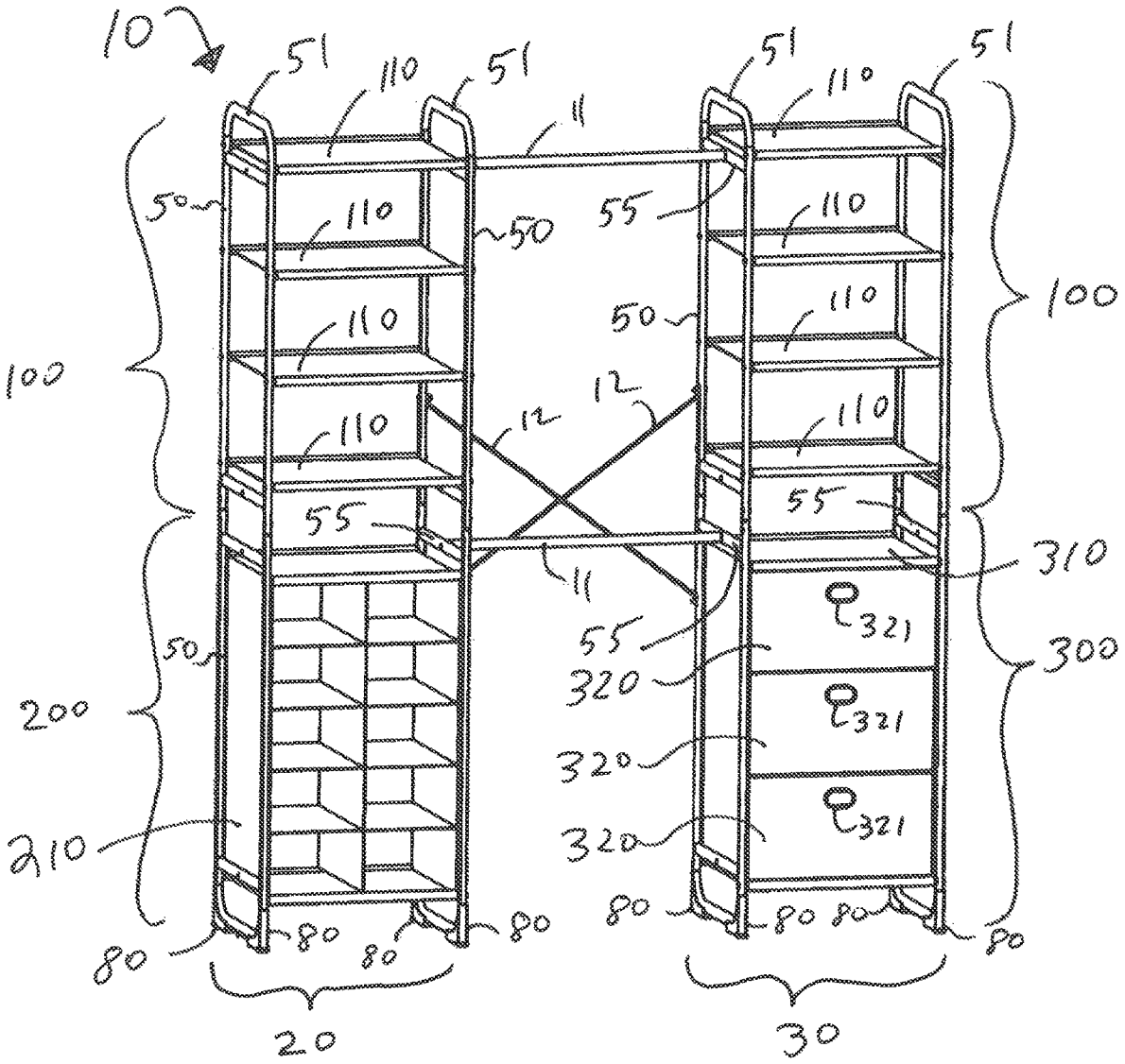
FIG. 1 is an elevated, front perspective view of a reconfigurable modular storage system embodying the present invention

While the present invention is susceptible of embodiment in many different forms, there is shown in the drawings and will herein be described in detail, several specific embodiments, with the understanding that the present disclosure is intended as an exemplification of the principles of the present invention and is not intended to limit the invention to the embodiments illustrated.

An embodiment of the present reconfigurable modular storage system 10 is shown in FIG. 1 as comprising two shelf storage units 100, cubbyhole storage unit 200, and drawer storage unit 300. One shelf storage unit 100 is coupled to and vertically stacked above cubbyhole storage unit 200 to form left tower 20. The other shelf storage unit 100 is coupled to and vertically stacked above drawer storage unit 300 to form right tower 30. Each of the various storage units 100, 200 and 300 is constructed, in part, of two end frame members 50 disposed on opposing sides of the respective storage unit. For added stability, and as shown in FIG. 1, a pair of cross braces 12 are each coupled between an upper end frame member 50 of one tower (20, 30) and a lower end frame member of an opposing tower (30, 20). Moreover, two garment hanging rods 11 are each coupled between end frame members 50 of left tower 20 and right tower 30, with one garment hanging rod 11 being coupled across the upper end frame members 50 of each tower (20, 30), and the other garment hanging rod 11 being coupled across the lower end frame members 50 of each tower (20, 30).

Figure 2:
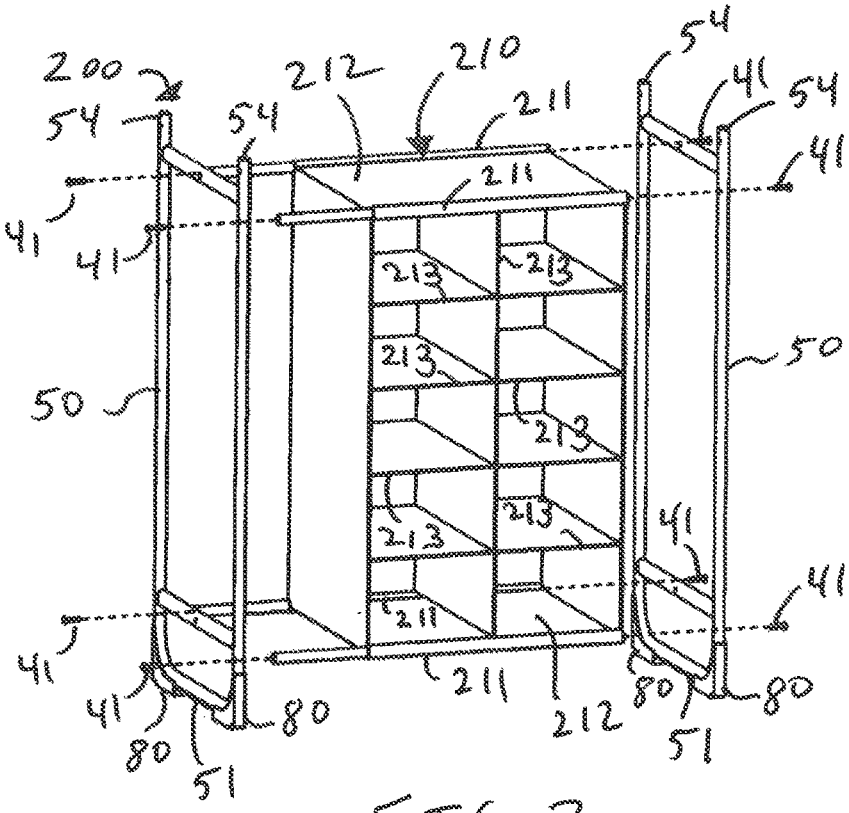
FIG. 2 is an elevated, front perspective, exploded view of a cubbyhole unit of the modular storage unit of FIG. 1.

Referring to FIG. 2, cubbyhole storage unit 200 is shown as comprising body 210 disposed between two end frame members 50 disposed on opposing sides of the overall storage unit. Body 210, which may be constructed primarily of a fabric material, includes four transversely oriented sleeves 211. Each sleeve 211 permits an associated rod 40 (see, e.g., FIG. 3) to be inserted therein. Each rod 40, which may be constructed of steel or other suitably rigid material, has two threaded apertures on its opposing ends. Fasteners 41, which may comprise screws, are disposed through apertures 56 (see, e.g., FIG. 5) of the end frame members 50 disposed on opposing sides of cubbyhole storage unit 200, and secured to the threaded apertures of opposing ends of corresponding rods 40. In this manner, body 210, which may be fan folded into a relatively flat and compact configuration for shipping, is fully expanded and stretched between end frame members 50 disposed on opposing sides of cubbyhole storage unit 200, upon assembly of cubbyhole storage unit 200.

Body 210 further includes two reinforced panels 212, and ten storage cubbyholes 213. Reinforced panels 212 may include a paperboard, cardboard, wire frame, or other suitable internal stiffener sandwiched between upper and lower layers of fabric, and positioned between opposing sleeves 211 of body 210.

With further reference to FIG. 2, each end frame member 50 further includes two opposing base members 80 coupled to first end 51 of frame member 50. As will be detailed further below, whenever two end frame members 50 are vertically stacked to form a tower of storage units, base members 80 are employed to provide enhanced stability for the tower of storage units.

Figure 3:
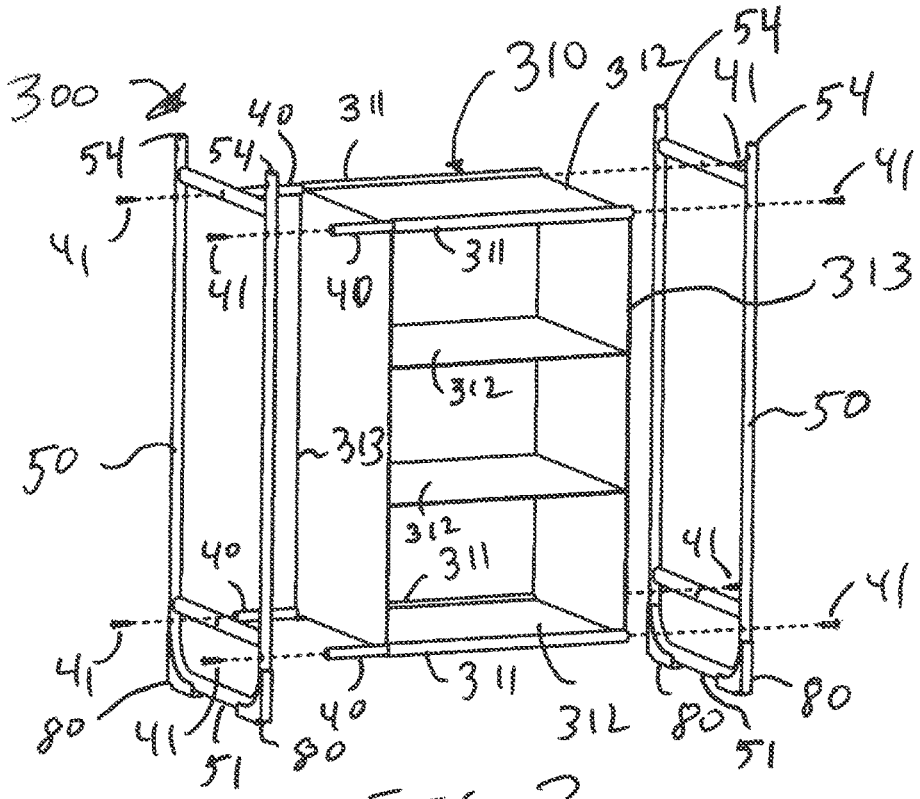
FIG. 3 is an elevated, front perspective, exploded view of a portion of a drawer unit of the modular storage unit of FIG. 1.

Referring to FIG. 3, drawer storage unit 300 is shown as comprising body 310 disposed between two end frame members 50 disposed on opposing sides of the storage unit. Body 310, which may be constructed primarily of a fabric material, includes four transversely oriented sleeves 311. Each sleeve 311 permits an associated rod 40 to be inserted therein. Fasteners 41 are disposed through apertures 56 (see, e.g., FIG. 5) of the end frame members 50 disposed on opposing sides of the storage unit, and secured to the threaded apertures of opposing ends of corresponding rods 40. In this manner, body 310, which may be fan folded into a relatively flat and compact configuration for shipping, is fully expanded and stretched between end frame members 50 disposed on opposing sides of drawer storage unit 300, upon assembly of drawer storage unit 300.

Body 310 further includes four reinforced panels 312 and two opposing side panels 313. Reinforced panels 312 may include a paperboard, cardboard, wire frame, or other suitable internal stiffener sandwiched between upper and lower layers of fabric, and positioned between opposing sleeves 311 of body 310. As shown in FIG. 1, three drawers 320, each having an associated handle aperture 321, may be placed in, and slid axially back and forth within, an associated aperture between two vertically opposed reinforced panels 312, and two horizontally opposed side panels 313. Each drawer 320 may be constructed primarily of a fabric material, and may be collapsible for shipment, such as, for example, having side surfaces constructed of two stiffened fabric segments, separated by a vertical fabric seam, which acts as a hinge, permitting the fabric segments to fold inwardly, bringing the front and rear surfaces of the drawer into proximity with each other. Moreover, each drawer may include a separable bottom stiffening insert consisting of a reinforced fabric material surrounding a paperboard, cardboard, wire frame, or other suitable internal stiffener, insertable into and removable from an associated drawer 320 through its top opening.

Figure 4:
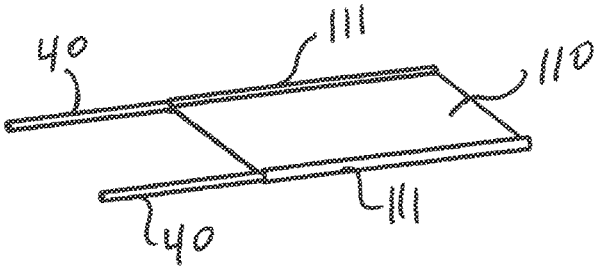
FIG. 4 is an elevated, front perspective, exploded view of a shelf assembly of the shelving unit of the modular storage unit of FIG. 1.

Referring to FIGS. 1 and 4, two shelf storage units 100, each positioned atop an associated tower, are each shown as comprising comprises four shelves 110 disposed between two opposing frame members 50. Each shelf 110 may be constructed primarily of a flexible fabric material, and includes two opposing, transversely oriented sleeves 111. Each sleeve 111 permits an associated rod 40 to be inserted therein. Fasteners 41 are disposed through apertures 56 (see, e.g., FIG. 5) of the end frame members 50 disposed on opposing sides of shelf storage unit 100, and secured to the threaded apertures of opposing ends of corresponding rods 40. In this manner, each shelf 110 is fully expanded and stretched between the end frame members 50 disposed on opposing sides of shelf storage unit 100, which, in turn, lends significant rigidity to the fabric of each shelf 110, and enables each shelf 110 to act as a support for the storage of garments or other articles placed thereupon.

Figure 5:
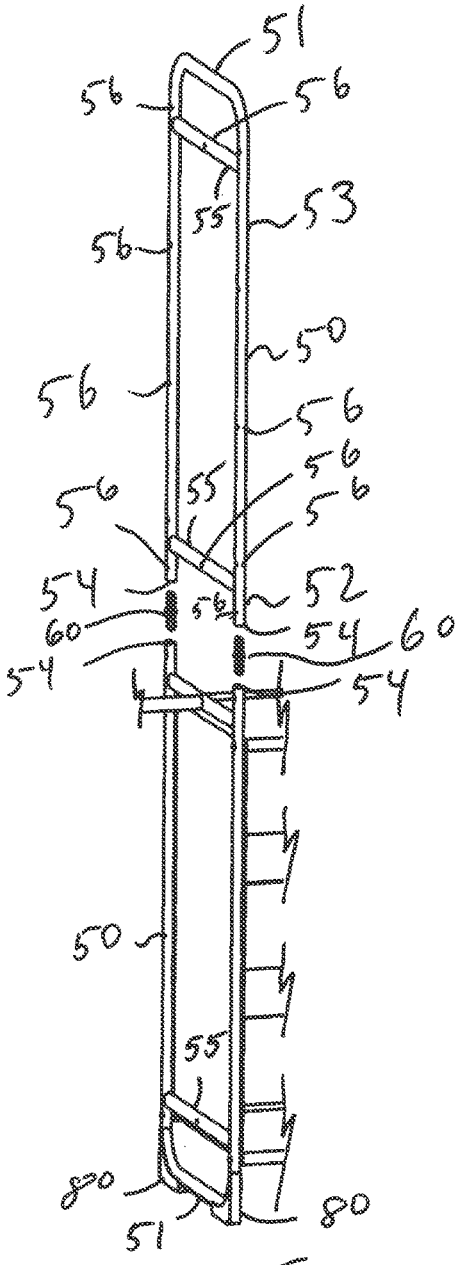
FIG. 5 is an elevated, front top perspective, exploded view of two end frame members of one tower of the modular storage unit of FIG. 1.

Referring to FIG. 5, the vertical assembly of two end frame members 50 into a portion of a tower of two vertically stacked storage units of the present reconfigurable modular storage system is shown. Each end frame member comprises first end 51 and second end 52, and is constructed of an elongated U-shaped member 53 having open tubular ends 54, and two cross-members 55. Each of elongated U-shaped member 53 and cross-members 55 are preferably constructed of a tubular steel material that is generally obround or stadium-shaped in cross-section. Welding or other suitable attachment means are employed to securely couple the opposing ends of each cross-member 55 to an inner surface of U-shaped member 53. As shown in FIG. 5, a central, arcuate portion of U-shaped member 53 is disposed at first end 51, and open tubular ends 54 are disposed at second end 52 of end frame member 50.

Moreover, and as shown in FIG. 5, the upper and lower end frame members 50, when vertically stacked to form a tower of two storage units, are placed in reverse orientations, relative to each other. Lower end frame member 50 is disposed with first end 51 at the bottom, with two base members 80 being attached in an opposing orientation, relative to each other, at first end 51 for enhanced stability of the assembled tower. Upper end frame member is disposed with first end 51 at the top. In this orientation, the arcuate shape of first end 51 of elongated U-shaped member 53 serves as a side rail or side railing of an associated, fully assembled storage unit. Depending upon the particular storage unit formed using two opposing upper end frame members 50, the arcuate shape of first end 51 may serve as a raised side rail or side railing of a top shelf 110 of a shelf storage unit 100, or the raised side rail or side railing of a top, generally planar surface of either a body 210 of a cubbyhole storage unit 200 or a body 310 of a drawer storage unit 300.

Figure 6:
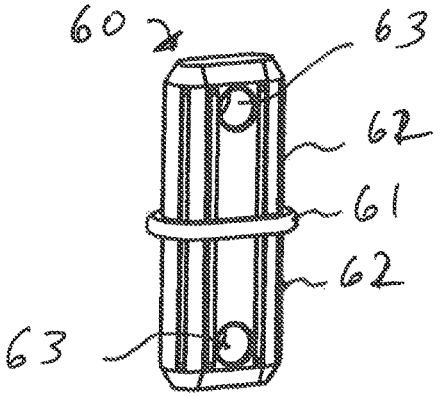
FIG. 6 is an enlarged, elevated, front perspective view of a coupling member of FIG. 5.

As shown in FIG. 5, when two end frame members 50 are placed in reverse orientations for stacking, their respective pairs of open tubular ends 54 face each other. In order to couple and secure the two end frame members 50 together, coupler 60 is inserted between each opposing pair of open tubular ends 54. Referring to FIG. 6, coupler 60, which may be constructed of a relatively rigid plastic material, comprises a central, raised shoulder 61, disposed between opposing insert regions 62. Each insert region 62 is, like open tubular ends 54 of end frame member 50, generally obround or stadium-shaped in cross-section, and sized to be snugly press-fit within an associated open tubular end 54 of end frame member 50. Each insert region 62 of coupler 60 further includes an associated fastener aperture 63.

Upon complete insertion of insert region 62 through an associated open tubular end 54 of elongated U-shaped member 53 of end frame member 50, shoulder 61 rests adjacent second end 52 of end frame member 50, and fastener aperture 63 of coupler 60 is axially aligned with two opposing fastener apertures 56 of elongated U-shaped member 53. This, in turn, permits a single fastener to be inserted though a first fastener aperture 56 of end frame member 50, fastener aperture 63 of coupler 60, and a second fastener aperture 56 of end frame member 50, thereby further securing coupler 60 to an end frame member 50. Upon securing each to two opposing insert regions 62 to an associated end frame member 50 in this manner, two opposing open tubular ends 54 of two end frame members 50 are secured together. By using two couplers 60 in this manner, each with two opposing open tubular ends 54 of two end frame members 50, two end frame members 50 of two storage units are secured together in a vertically stacked, tower arrangement.

Although, in the embodiment of FIG. 1, a modular storage unit having four storage units, organized into two vertically stacked towers, with two hanging rods is disclosed, many other configurations are contemplated by the present invention. Each of shelving storage unit 100, cubbyhole storage unit 200, and drawer storage unit 300 may optionally be assembled as a stand-alone storage unit. When so configured, each storage unit is assembled with two end frame members 50 disposed on opposing sides of the storage unit, oriented with first end 51 at the top end of the storage unit, and with second end 52 at the bottom end of the storage unit. In this configuration, the arcuate center region of elongated U-shaped member 53 serves as a raised end rail or end railing for a top shelf 110 of a shelving storage unit 100, or for a top surface of a cubbyhole unit body 210 or drawer unit body 310 of a cubbyhole storage unit 200 or drawer storage unit 300, respectively.

Figure 7:
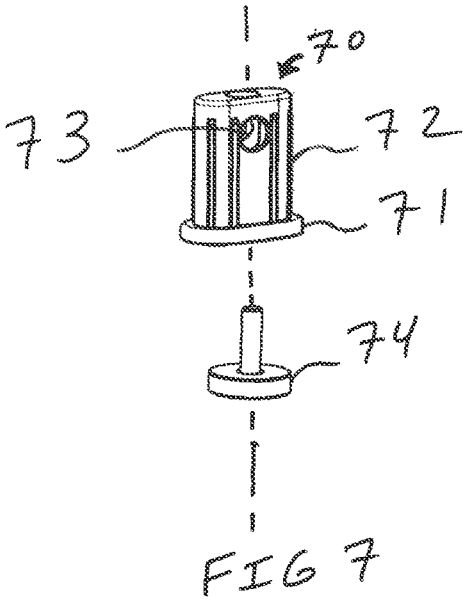
FIG. 7 is an enlarged, elevated, front perspective, exploded view of an adjustable footing of the present invention.

Moreover, when so configured, and with reference to FIG. 7, four footings 70 are inserted into corresponding open tubular ends 54 of two end frame members 50 disposed on opposing sides of the storage unit, to better support the stand-alone storage unit on a floor or other relatively planar surface. As shown in FIG. 7, footing 70, which may be constructed of a relatively rigid plastic material, comprises shoulder 71 adjacent insert region 72. Insert region 72, like open tubular ends 54 of end frame member 50, is generally obround or stadium-shaped in cross-section, and sized to be snugly press-fit within an associated open tubular end 54 of end frame member 50. Each insert region 72 of footing 70 further includes an associated fastener aperture 73. Upon complete insertion of insert region 72 through an associated open tubular end 54 of elongated U-shaped member 53 of end frame member 50, shoulder 71 rests adjacent second end 52 of end frame member 50, and fastener aperture 73 of footing 70 is 50.

Footer 70 further includes height adjustment member 74, having a foot pad and a threaded shaft that is received by a threaded bottom aperture of footing 70. By adjusting the degree of threaded insertion of the shaft of height adjustment member into the threaded bottom aperture of footing 70, the overall height of footing 70 may be adjusted. Accordingly, any of the four footings associated with a particular stand-alone storage unit may be adjusted in order to level the overall storage unit as desired.

In addition to stand-alone storage units and the fully configured modular storage unit of FIG. 1, still other configurations of storage units are contemplated by the present invention. In particular, any combination of two stand-alone storage units, assembled as described above, may be placed proximate each other and interconnected via a garment hanging rod 11, by advancing a fastener 41 axially through two parallel fastener apertures 56 at first end 51 of each of two inner end frame members 50 of two storage units, and securing the fasteners to opposing ends of the garment hanging rod 11, thereby providing a convenient surface for hanging garments between two storage units.

Figure 8:
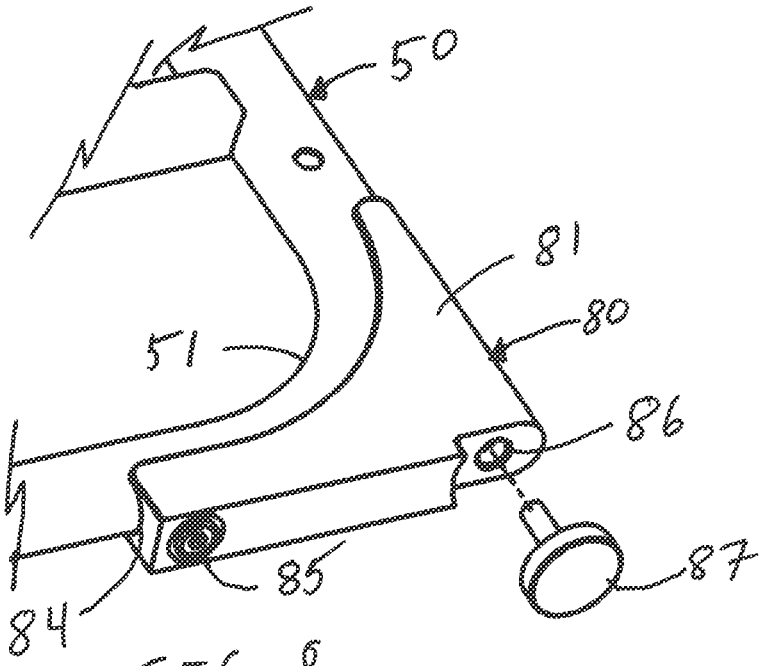
FIG. 8 is an elevated, side perspective view of a base member of the modular storage unit of FIG. 1, shown attached to an end frame member.
Figure 9:
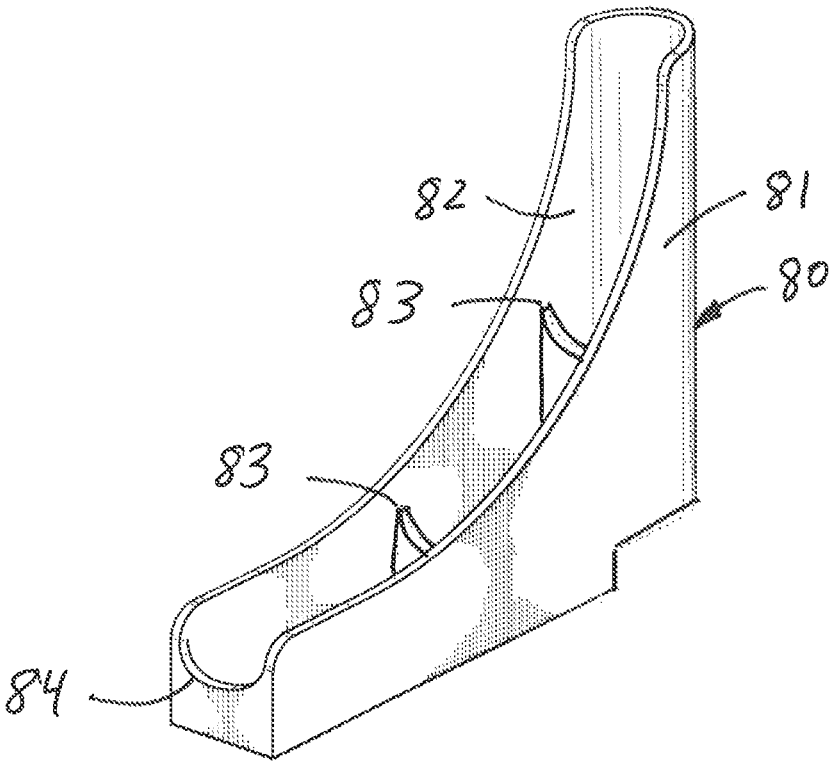
FIG. 9 is an elevated, perspective view of the base member of FIG. 8, showing a portion of the interior region thereof.

Base member 80 is shown in further detail in FIGS. 8 and 9 as comprising body 81 having front lip 84 and interior 82 which, in turn, has a plurality of raised bosses 83 disposed therein. Front lip 84 and each raised boss 83 increase progressively in height from front lip 84 towards the rear of base member 80. Moreover, each of front lip 84 and raised bosses 83 have an arcuately recessed top surface. Upon attachment of base member 80 to frame member 50, lip 84 and raised bosses 84 collectively engage and support an arcuate corner of first end 51 of end frame member 50. Upon attachment of two base members 80 to opposing arcuate corners of first end 51 of end frame member 50, the base members effectively "square off" the rounded corners of first end 51, collectively serving as a base for the end frame member and the storage unit, supporting the end frame member and the storage unit above the floor or another generally planar surface, and providing enhanced, load-bearing support for an overall tower consisting of two vertically stacked storage units of the present invention.

To securely attach base member 80 to a corner of first end 51 of end frame member 50, a fastener is extended axially through fastener aperture 85, and is then coupled to first end 51, such as by engaging a threaded aperture of end frame member 50. As shown in FIG. 8, base member 80 further includes height adjustment member 87, having a foot pad and a threaded shaft that is received by a threaded bottom aperture 86 of base member 80. By adjusting the degree of threaded insertion of the shaft of height adjustment member into the threaded bottom aperture 86 of base member 80, the overall height of base member 80 may be adjusted. Accordingly, any of the four base members associated with a particular storage unit may be adjusted in order to level the overall storage unit, and an overall tower of two vertically stacked storage units, as desired.

As can be seen, the use of end frame member 50 within reconfigurable modular storage unit is quite versatile. Firstly, a common end frame member 50 design is employed, in opposing pairs, to construct each of shelving storage unit 100, cubbyhole storage unit 200, and drawer storage unit 300. Moreover, end frame member 50 may be used in differing (i.e., reverse) orientations, depending upon whether it is being used to construct a stand-alone storage unit, an upper tier storage unit of a vertically stacked tower, or a lower tier storage unit of a vertically stacked tower.

In particular, when a pair of end frame members 50 are employed to construct either a stand-alone storage unit, or the upper storage unit of a vertically stacked tower, they are oriented with their first ends 51 towards the top and their second ends 52 towards the bottom, as shown, for example, in the shelving storage units 100 of FIG. 1. In this orientation, the region of end frame members 50 above the upper cross-member 55, having arcuate corners, serves as a side rail or side railing of a top shelf 110 of a shelf storage unit 100, or the side rail or side railing of a top surface of either a body 210 of a cubbyhole storage unit 200 or a body 310 of a drawer storage unit 300. Moreover, in this orientation, couplers 60 and associated fasteners 41 may be employed to connect the open tubular ends 54 of the upper end frame members 50 to the open tubular ends 54 of corresponding, opposingly oriented frame members 50, as shown, for example, in FIG. 5. Moreover, in this orientation, instead of couplers 60, footings 70 and associated fasteners 41 may be employed to enable the associated storage unit of the pair of end frame members 50 to instead be used as either a stand-alone storage-unit, or as a part of a larger modular unit comprising two storage units coupled together by a hanging rod 11.

In addition, when a pair of end frame members are instead employed to construct a lower storage unit of a vertically stacked tower, they are oriented with their second ends 52 towards the top and their first ends 51 towards the bottom, as shown, for example, in the cubbyhole storage unit 200 and drawer storage unit 300 of FIG. 1. In this orientation, two base members 80 are attached in opposing fashion to first end 51 of each end frame member. Upon attachment, portions of the central linear region and rounded corners of first end 51 of each end frame member 50 are supported by lip 84 and raised bosses 83, respectively, of base members 80, effectively squaring off the rounded corners of first ends 51, and extending the central linear region of first end 51 disposed between the rounded corners. This, in turn, provides enhanced support and stability when a second modular storage unit, constructed using reversely oriented end frame members 50, is coupled immediately above the present end frame members 50 to form a 2-tier tower of modular storage units.

Many modifications and variations of the present invention are possible in light of the above teachings. It is therefore to be understood that within the scope of the appended claims, the invention may be practiced other than as specifically described. Various modifications, changes and variations may be made in the arrangement, operation and details of construction of the invention disclosed herein without departing from the spirit and scope of the invention. The present disclosure is intended to exemplify and not limit the invention.

What is claimed is:

1. A reconfigurable frame attachable to a storage unit, comprising:

a first end frame member having a first end and a second end;

the first end frame member being attachable to the storage unit in a first orientation relative to the storage unit, wherein the first end of the first end frame member is positioned vertically above the second end of the first end frame member;

the first end frame member being attachable to the storage unit in a second orientation relative to the storage unit that is different than the first orientation, wherein the second end of the first end frame member is positioned vertically above the first end of the first end frame member;

at least one base member attachable to the first end of the first end frame member;

wherein, when the first end frame member is attached to the storage unit in the first orientation and the at least one base member is unattached to the first end frame member and is instead attached to a different portion of the frame, at least a portion of the first end of the first end frame member serves as a raised end railing of a topmost horizontal surface of the storage unit; and wherein, when the first end frame member is attached to the storage unit in the second orientation and the at least one base member is attached to the first end of the first end frame member, at least a portion of the at least one base member serves as a load-bearing support for the first end frame member and for the storage unit.

2. The invention according to claim 1, wherein the at least one base member comprises two base members attachable to the first end of the first end frame member in opposing orientations relative to each other.

3. The invention according to claim 1, wherein the first end of the first frame member includes at least one rounded corner region.

4. The invention according to claim 3, wherein the at least one base member supports and substantially covers an outer surface of the at least one rounded corner region upon attachment of the at least one base member to the first end frame member.

5. The invention according to claim 1, wherein the at least one base member further comprises a height adjustment member.

6. The invention according to claim 1, further comprising:

a second end frame member having a first end and a second end, the second end frame member being identical in shape to the first end frame member;

wherein the first end frame member and the second end frame member are stackable by placing the first end frame member in the second orientation, placing the second end frame member above the first end frame member in an inverted orientation relative to the second orientation of the first end frame member, and coupling the second end of the first end frame member to the second end of the second end frame member.

7. The invention according to claim 6, further comprising at least one coupler coupling at least a portion of the second end of the first end frame member to at least a portion of the first end of the second end frame member.

8. The invention according to claim 1, further comprising:

a second end frame member having a first end and a second end, the second end frame member being identical in shape to the first end frame member;

the second end frame member being attachable to the storage unit in a first orientation, wherein the first end of the second end frame member is positioned vertically above the second end of the second end frame member;

the second end frame member being attachable to the storage unit in a second orientation, wherein the second end of the second end frame member is positioned vertically above the first end of the first end frame member;

wherein the first end frame member and the second end frame members are disposed on opposing sides of the storage unit.

9. The invention according to claim 8, wherein the first end frame member is in its first orientation and the second end frame member is in its first orientation.

10. The invention according to claim 8, wherein the first end frame member is in its second orientation and the second end frame member is in its second orientation.

11. The invention according to claim 1, wherein the reconfigurable frame is attachable to a storage unit selected from the group comprising a shelf storage unit, a drawer storage unit, and a cubbyhole storage unit.

* * * * *